US010023447B2

(12) United States Patent
Greenfield

(10) Patent No.: US 10,023,447 B2
(45) Date of Patent: Jul. 17, 2018

(54) WHEELCHAIR ACCESSIBLE FORKLIFT

(71) Applicant: Harlan Greenfield, Martinsburg, WV (US)

(72) Inventor: Harlan Greenfield, Martinsburg, WV (US)

( * ) Notice: Subject to any disclaimer, the term of this patent is extended or adjusted under 35 U.S.C. 154(b) by 48 days.

(21) Appl. No.: 14/678,172

(22) Filed: Apr. 3, 2015

(65) Prior Publication Data

US 2015/0344276 A1 Dec. 3, 2015

Related U.S. Application Data

(60) Provisional application No. 62/003,681, filed on May 28, 2014.

(51) Int. Cl.
*B66F 9/075* (2006.01)

(52) U.S. Cl.
CPC ..... *B66F 9/0759* (2013.01)

(58) Field of Classification Search
CPC ..... B66B 9/08; B66B 9/0853; B66F 9/0759; B66F 9/07568; B66F 9/07
USPC ..... 187/222
See application file for complete search history.

(56) References Cited

U.S. PATENT DOCUMENTS 3,263,777 A * 8/1966 Robichon ..... B66F 9/06 180/69.6
3,485,314 A * 12/1969 Herr ..... B60P 9/00 180/11
3,489,249 A * 1/1970 Stammen ..... B66F 9/08 187/226
4,336,860 A 6/1982 Noller et al.
4,415,056 A * 11/1983 Smith ..... B62K 5/025 180/210
4,518,057 A * 5/1985 McCallum ..... A61G 3/065 180/210
4,580,652 A * 4/1986 Turner ..... A61G 3/061 180/11
4,984,955 A * 1/1991 McCullough ..... B66B 9/00 187/243
5,305,845 A * 4/1994 Van Dooren ..... A61G 3/065 180/65.1
6,189,964 B1 2/2001 Henshaw et al.
7,337,864 B2 3/2008 Ruck
7,419,024 B1 * 9/2008 Tavantzis ..... A61G 3/061 180/210
7,757,798 B2 * 7/2010 Niemeier ..... B66F 9/07518 180/89.1
2001/0032916 A1 * 10/2001 Wess ..... A61G 5/10 248/349.1
2004/0134692 A1 * 7/2004 Kime ..... B62D 51/04 180/19.1

(Continued)

*Primary Examiner* — Michael A Riegelman
(74) *Attorney, Agent, or Firm* — Global Intellectual Property Agency, LLC; Jordan Sworen

(57) ABSTRACT

A wheelchair accessible forklift is provided. The wheelchair accessible forklift includes a forklift assembly having an operator station having a flat platform portion. The flat platform portion has a first end and a second end. The flat platform portion is configured to support a wheelchair thereon. A ramp is hingably connected to the second end of the flat platform portion to allow the wheelchair to enter and exit the flat platform portion. The first end of the flat platform is removably attached to the forklift assembly.

12 Claims, 3 Drawing Sheets

(56) References Cited

U.S. PATENT DOCUMENTS

| | | | | |
|---|---|---|---|---|
| 2005/0247508 | A1* | 11/2005 | Gilliland | B62B 5/06 180/402 |
| 2007/0207023 | A1 | 9/2007 | O'Keeffe | |
| 2008/0283320 | A1* | 11/2008 | Bowles | A61G 5/047 180/210 |
| 2009/0041564 | A1* | 2/2009 | Borntrager | B66F 9/065 414/352 |
| 2009/0158536 | A1* | 6/2009 | Holicki | A61G 5/104 14/69.5 |
| 2010/0096204 | A1* | 4/2010 | Mosey | A61G 3/0808 180/210 |
| 2010/0183412 | A1* | 7/2010 | Borntrager | B66F 9/065 414/541 |
| 2014/0299417 | A1* | 10/2014 | Haythorne | B66F 9/07 187/224 |
| 2014/0299826 | A1* | 10/2014 | March | A61G 7/08 254/2 R |

* cited by examiner

WHEELCHAIR ACCESSIBLE FORKLIFT

CROSS REFERENCE TO RELATED APPLICATION

This application claims the benefit of U.S. Provisional Application No. 62/003,681 filed on May 28, 2014. The above identified patent application is herein incorporated by reference in its entirety to provide continuity of disclosure.

FIELD OF THE INVENTION

The present invention generally relates to relates to forklifts. More specifically, the present invention relates to a wheelchair accessible forklift that allows a user to control the forklift assembly with one arm.

BACKGROUND OF THE INVENTION

Forklifts allow a user to lift and transport heavy materials for relatively short distances. Forklifts have become an indispensable piece of equipment in warehouse and manufacturing facilities for its operative ease and convenience. Forklift trucks generally must be short and maneuverable in narrow spaces. In such front end forklifts, the space between the front end lift structure and the rear box structure is tight and the rear box structure generally extends over the full width of the fork lift and accommodates the batteries and/or other drive components. The rear box structure also serves as a counterweight to the front end lift structure. An operator seat is also generally mounted rigidly onto the cover of the rear box structure.

This type of forklift design prevents a person restricted to a wheelchair from operating such a device. Many people are disabled and as a result of their handicap, are confined to wheelchairs. Particularly, people who have suffered from the loss of a leg may require the use of a wheelchair for transportation. These handicapped individuals are generally unable to perform labor requiring operation of heavy machinery, such as forklifts. Further, workers that typically operate heavy machinery but are temporarily injured are unable to operate the heavy machinery during their recovery period. Thus, a forklift device that is operable by a handicapped individual is desired.

Devices are known in the prior art that relate to forklift assemblies. These include devices that have been patented and published in patent application publications. These devices generally relate to forklifts having specific seating configurations or having platforms on which the operator can stand. The following is a list of devices deemed most relevant to the present disclosure, which are herein described for the purposes of highlighting and differentiating the unique aspects of the present invention, and further highlighting the drawbacks existing in the prior art.

Some patents provide a forklift with an operator station that includes seat assemblies that allow an operator to sit, stand or perch, such as U.S. Pat. No. 6,189,964, U.S. Pat. No. 7,337,864, U.S. Pat. No. 7,757,798, and U.S. Pat. No. 4,336,860. Other patents provide a forklift with a fixed operator platform, including U.S. Published Patent Application Number 2007/0207023 and U.S. Pat. No. 7,757,798.

These prior art devices have several known drawbacks. Devices in the prior art fail to provide a forklift assemblies that are capable of supporting and securing a wheelchair thereon, and operable by a single lever. The present invention provides a forklift assembly having an operator station with a flat platform portion that is configured to support a wheelchair thereon, and a ramp hingably connected to the flat platform portion to allow a wheelchair to enter and exit the flat platform portion.

In light of the devices disclosed in the prior art, it is submitted that the present invention substantially diverges in design elements from the prior art and consequently it is clear that there is a need in the art for an improvement to existing forklift assemblies devices. In this regard the instant invention substantially fulfills these needs.

SUMMARY OF THE INVENTION

In view of the foregoing disadvantages inherent in the known types of forklift assemblies now present in the prior art, the present invention provides a wheelchair accessible forklifts wherein the same can be utilized for providing convenience for the user when an individual is operating a forklift assembly while confined to a wheelchair.

It is therefore an object of the present invention to provide a new and improved wheelchair accessible forklift that has all of the advantages of the prior art and none of the disadvantages.

It is another object of the present invention to provide a wheelchair accessible forklift. The wheelchair accessible forklift includes a forklift assembly comprising an operator station having a flat platform portion. The flat platform portion has a first end and a second end. The flat platform portion is configured to support a wheelchair thereon. The flat platform portion may further include a turntable to allow a wheelchair to turn thereon.

It is yet another object of the present invention to provide a ramp hingably connected to the second end of the flat platform portion. The ramp is configured to allow the wheelchair to enter and exit the flat platform portion. The ramp locks into a fixed position after a wheelchair is secured to the flat platform portion.

It is still yet another object of the present invention to provide a first end of the flat platform that is configured to removably attach to the forklift assembly.

Another object of the present invention is to provide a forklift device that is operable by an individual confined to a wheelchair and uses a single hand lever to control operation of the forklift.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
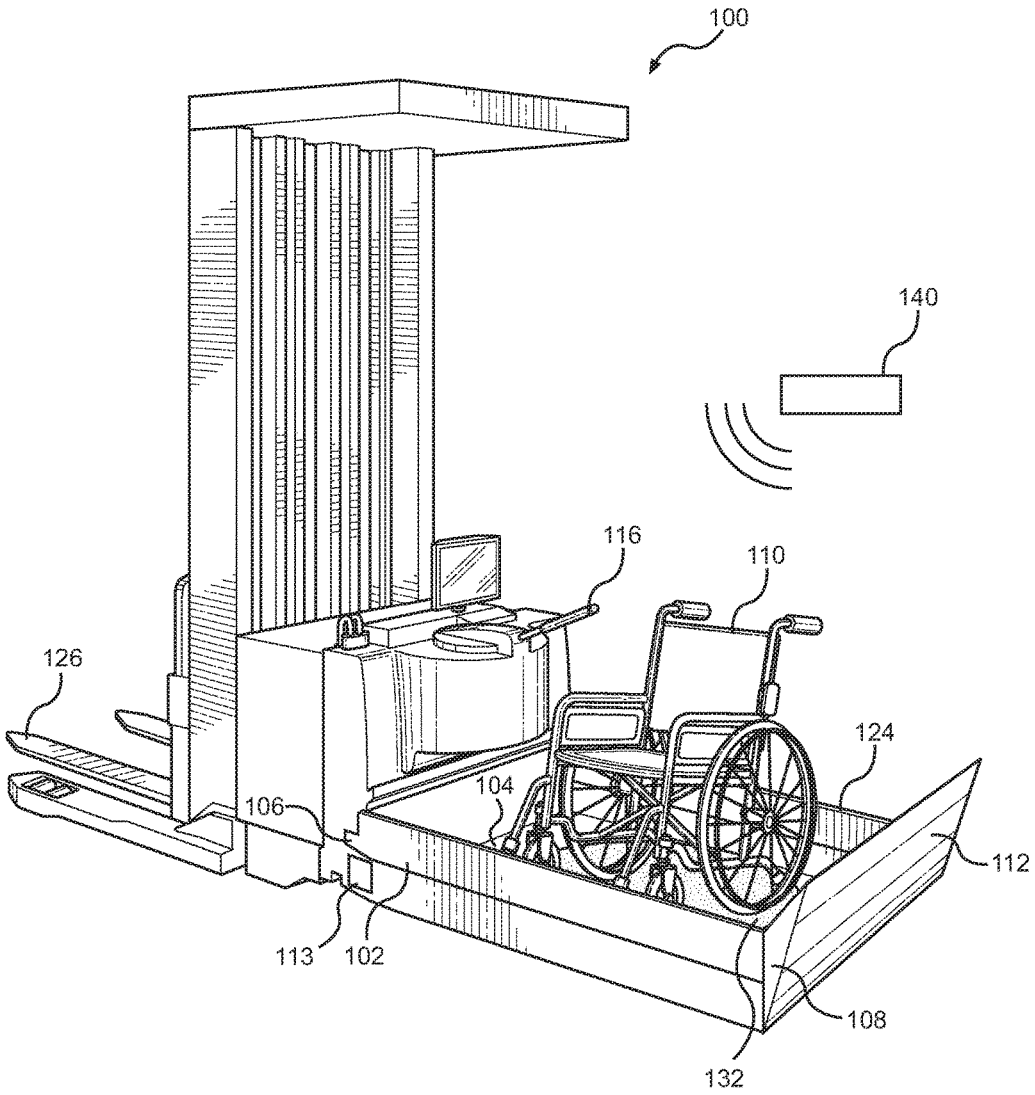
FIG. 1 shows a perspective view of a wheelchair accessible forklift with a wheelchair secured to an operator station according to one embodiment of the present invention.

Reference is made herein to the attached drawings. Like reference numerals are used throughout the drawings to depict like or similar elements of the wheelchair accessible forklift. For the purposes of presenting a brief and clear description of the present invention, the preferred embodiment will be discussed as used for lifting heavy objects. The figures are intended for representative purposes only and should not be considered to be limiting in any respect.

Referring now to FIG. 1, there is shown a perspective view of the wheelchair accessible forklift. The wheelchair accessible forklift includes a forklift assembly comprising an operator station 102 and a forklift head. The operator station 102 comprises a flat platform portion 104 with a wheelchair secured to the operator station according to one embodiment of the present invention. The wheelchair accessible forklift includes a forklift assembly 100 comprising an operator station 102 having a flat platform portion 104. The operator station 102 includes a single hand lever 116 to operate the forklift assembly 100. The single hand lever 116 controls the direction and speed of travel of the forklift assembly 100, as well as fork 126 height, fork 126 extension, and fork 126 tilt and side-shift.

The flat platform portion 104 has a first end 106 and a second end 108. It is contemplated that the flat platform portion 104 is configured to support a wheelchair 110 thereon. Preferably, the flat platform portion 104 may comprise a rubber surface that prevents a wheelchair from 110 slipping or moving while secured to the flat platform portion 104. The flat platform portion 104 may further include side walls 124, wherein the side walls 124 are on opposing sides of the flat platform portion 104. The side walls 124 prevent a wheelchair 110 from rolling off the flat platform portion 104. In some preferred embodiments, the flat platform portion 104 may further include a turntable 132 adapted to turn the wheelchair 110 thereon. The turntable 132 allows the wheelchair to turn about a 360 degree angle.

A ramp 112 is hingably connected to the second end 108 of the flat platform portion 104. The ramp 112 provides an angled gradient that slopes to the floor. The ramp 112 is configured to be placed flush against the floor to provide a wheelchair 110 to gain access to the flat platform portion 104. In this way, the ramp 112 is allows the wheelchair 110 to enter and exit the flat platform portion 104 by rolling the wheelchair 110 thereon and thereoff via the ramp 112. Once a wheelchair is secured in the flat platform portion 104, the ramp 112 may be lifted via a hinge member. In the lifted position, the ramp 112 serves as a back wall to prevent a wheelchair 110 from rolling off the flat platform portion 104. In one embodiment, the ramp 112 is controlled via a remote control 140.

The first end 106 of the flat platform portion 104 is configured to removably attach to the forklift assembly 100. The height of the flat platform portion 104 may be adjusted once the first end 106 is attached to the forklift assembly 100. The first end 106 provides a coupling member 113 that mates with a coupling member on the forklift assembly for removably attachment. The coupling member 113 may be a lock and pin, a bolt, or a latch, however, other suitable means for attachment are likewise contemplated. In other embodiments, the flat platform portion 104 may be integrally attached to the forklift assembly 100 rather than attached by a coupling member 113. These embodiments are also deemed within the scope and spirit of the inventive embodiments of the present disclosure.

Figure 2:
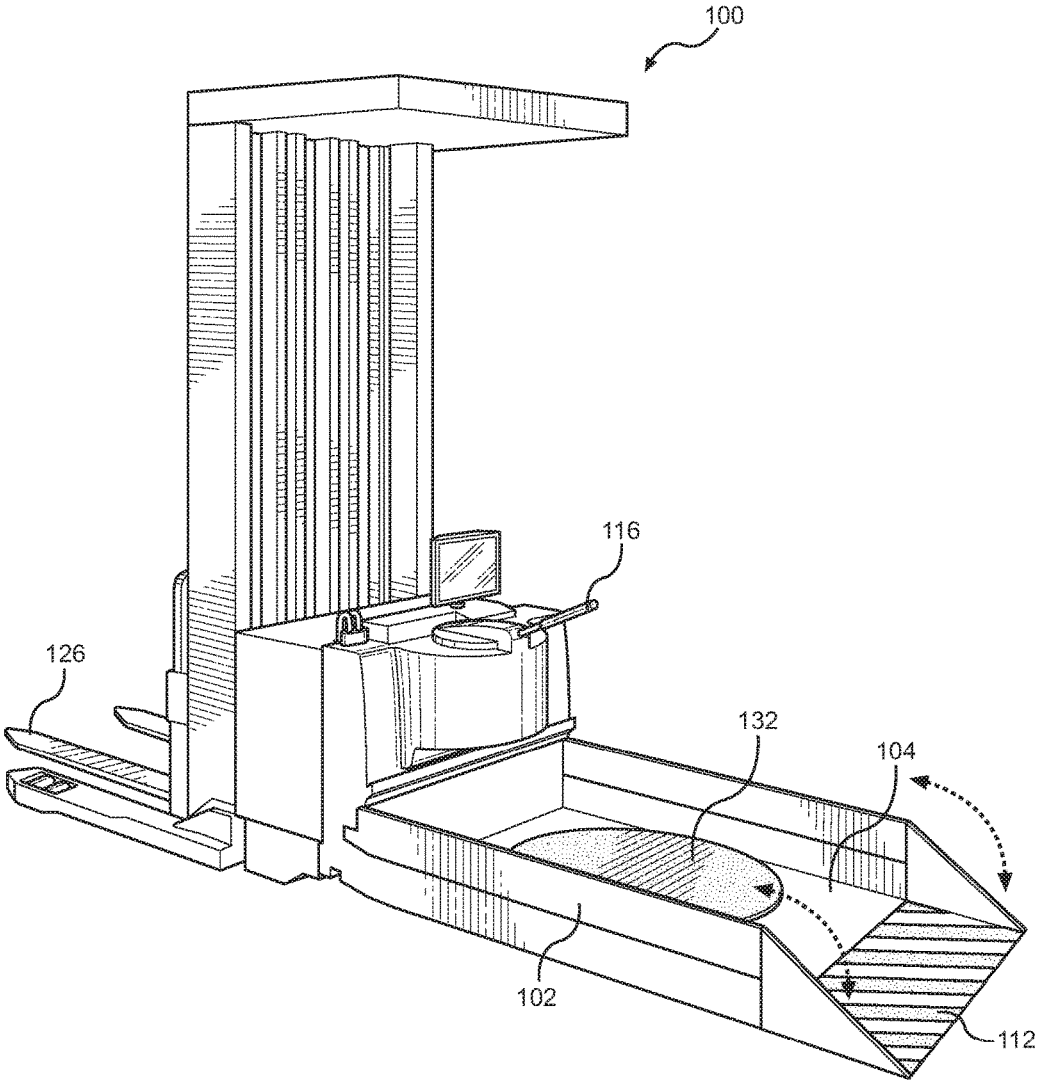
FIG. 2 shows a perspective view of the wheelchair accessible forklift according to one embodiment of the present invention.

Referring now to FIG. 2, there is shown a perspective view of the wheelchair accessible forklift assembly according to one embodiment of the present invention. The forklift assembly 100 includes an open operator station 102 having a flat platform portion 104 adapted to support a disabled operator in a wheelchair. The device comprises a forklift assembly 100 including an operator station 102 that is flat. The operator station 102 includes a ramp 112 for a disabled operator to enter the platform and access the controls. The forklift controls includes a single hand lever 116 that allows a user to control the motion of the forks 126 using one hand. The operator may be seated to the side in a wheelchair or may have a physical handicap that limits his ability to operate two-handed controls.

Figure 3:
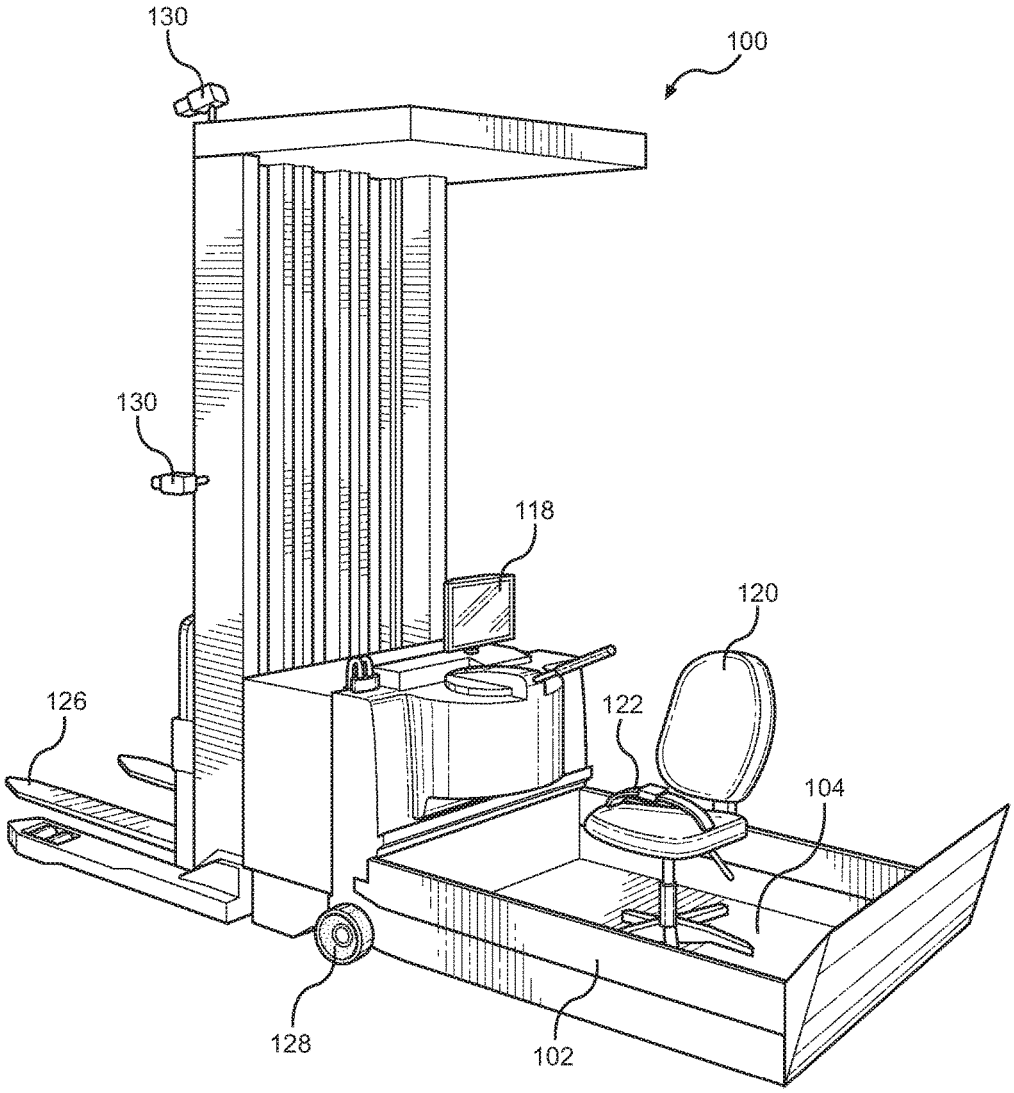
FIG. 3 shows an exploded view of a wheelchair accessible forklift with a chair secured to the flat platform portion according to one embodiment of the present invention.

Referring now to FIG. 3, there is shown another preferred embodiment of the wheelchair accessible forklift. This embodiment of the wheelchair accessible forklift includes a forklift assembly further comprising a chair secured to the flat platform portion The operator station 102 of the forklift assembly includes a control panel 118 for steering and operating the forklift assembly 100. The control panel 118 can also be used to operate the forklift and the platform on which a disabled user can be positioned. The control panel 118 includes one or more controls or levers for steering the forklift assembly 100 and operating the forks 126 of the forklift. In some embodiments of the present invention, such as the preferred embodiments illustrated in FIGS. 1 and 2, the forklift is operated by means of a single hand lever such that individuals having only one hand can operate the forklift.

The flat platform portion 104 of the forklift assembly is substantially flat and provides a surface on which a chair can be positioned, or on which a wheelchair can be positioned. The flat platform portion 104 provides the user with access to the control panel 118 so that the user may operate the forklift. The flat platform portion 104 includes a ramp 112 on an end thereof that allows a user in a wheelchair to easily enter and exit the operator station 102. A seat member 120 is affixed to the flat platform portion 104. The seat member 120 includes at least one strap 122 to secure a user to the seat member 120.

A plurality of motorized wheels 128 that allow the forklift to move from one location to another. Further, similar to conventional forklifts, the wheelchair accessible forklift 100 of the present invention includes a lifting mechanism having horizontally disposed forks 126 that can be raised or lowered about a vertical axis. Thus, according to one embodiment, the present invention provides a forklift assembly 100 having a modified operator station 102 that includes a flat platform portion 104 accessible by a user in a wheelchair. Further, the present invention may include one or more cameras 130 and a display that improves visibility for the forklift operator.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheelchair accessible forklift, comprising:

a forklift assembly comprising a forklift head and an operator station having a flat platform portion, the flat platform portion having a first end and a second end, wherein the flat platform portion is configured to support a wheelchair thereon;

a ramp hingably connected to the second end of the flat platform portion, wherein the ramp is configured to provide the wheelchair access to the flat platform portion;

wherein the first end of the flat platform is configured to removably attach to the forklift head via a coupling member;

the flat platform portion comprising a turntable adapted to rotate the wheelchair about a 360 degree angle, wherein the wheelchair is configured to rotate between facing the first end and facing the second end;

wherein the flat platform is statically disposed and comprises a uniform height entirely across the flat platform;

the ramp being disposed along a same plane as the flat platform when the ramp is disposed in a down position;

the operator station comprises a control panel for steering and operating the forklift assembly, the control panel disposed along a center axis between a pair of opposing distal sides of the operator station.

2. The wheelchair accessible forklift of claim 1, wherein the operator station includes a single hand lever to operate the forklift assembly.

3. The wheelchair accessible forklift of claim 1, wherein operator station comprises a control panel for steering and operating the forklift assembly.

4. The wheelchair accessible forklift of claim 1, where the ramp is controlled via a remote control.

5. The wheelchair accessible forklift of claim 1, wherein the flat platform portion has a width sized to accommodate the wheels of a wheelchair.

6. The wheelchair accessible forklift of claim 1, wherein the flat platform portion comprises a rubber surface configured to prevent the wheelchair from slipping thereon.

7. The wheelchair accessible forklift of claim 1, wherein the ramp is configured to act as a back wall to the flat platform when in a lifted position.

8. The wheelchair accessible forklift on claim 1, wherein a plurality of motorized wheels is operably disposed on the flat platform and is configured to enable movement of the wheelchair accessible forklift wherein the plurality of motorized wheels is configured to enable movement of the flat platform separately from the forklift head.

9. The wheelchair accessible forklift of claim 1, wherein the operator station further comprises at least one camera operably connected to a display thereof.

10. The wheelchair accessible forklift of claim 9, wherein at least one camera is placed on the forklift head such as to record a front-facing video feed and at least one camera is disposed on the forklift head such as to record a top-down video feed.

11. The wheelchair accessible forklift of claim 1, wherein the single hand lever is configured to enable one-handed operation of the wheelchair accessible forklift.

12. The wheelchair accessible forklift of claim 1, wherein a vertical height of the flat platform is adjustable.

* * * * *